US010894682B2

(12) United States Patent
Carver et al.

(10) Patent No.: US 10,894,682 B2
(45) Date of Patent: Jan. 19, 2021

(54) PACKAGED FLEXIBLE FILM AND FLEXIBLE FILM PACKAGING SYSTEM THEREFOR

(71) Applicant: EASTMAN PERFORMANCE FILMS, LLC, St. Louis, MO (US)

(72) Inventors: Peter Ian Carver, Greensboro, NC (US); Michael Hawkins, Martinsville, VA (US)

(73) Assignee: Eastman Performance Films, LLC, St. Louis, MO (US)

( * ) Notice: Subject to any disclaimer, the term of this patent is extended or adjusted under 35 U.S.C. 154(b) by 0 days.

(21) Appl. No.: 16/504,887

(22) Filed: Jul. 8, 2019

(65) Prior Publication Data

US 2019/0330002 A1 Oct. 31, 2019

Related U.S. Application Data

(63) Continuation of application No. 15/334,321, filed on Oct. 26, 2016, now abandoned.

(51) Int. Cl.
*B65H 19/28* (2006.01)
*B65B 63/04* (2006.01)
(Continued)

(52) U.S. Cl.
CPC ..... *B65H 19/283* (2013.01); *B65B 63/04* (2013.01); *B65D 65/14* (2013.01); *B65D 85/672* (2013.01); *B65H 2301/41427* (2013.01); *B65H 2301/41428* (2013.01); *B65H 2511/166* (2013.01); *B65H 2701/1752* (2013.01)

(58) Field of Classification Search
CPC ..... B65B 63/04; B65D 65/14; B65D 85/672; B65H 19/283; B65H 2301/41427; B65H 2301/41428; B65H 2511/166; B65H 2701/1752
See application file for complete search history.

(56) References Cited

U.S. PATENT DOCUMENTS 2,253,922 A 8/1941 Cleef
3,124,497 A 3/1964 Sydanmaa
(Continued)

FOREIGN PATENT DOCUMENTS

CN 204138048 4/2015
DE 4306169 11/1993
(Continued)

OTHER PUBLICATIONS

Copending U.S. Appl. No. 15/334,321, filed Oct. 26, 2016, Carver et al.
(Continued)

*Primary Examiner* — William A. Rivera
(74) *Attorney, Agent, or Firm* — Michael K. Carrier

(57) ABSTRACT

A packaged flexible film is described. The packaged flexible film includes (i) a cylindrical core having an outer surface; (ii) a supply of flexible film wound about the core with a leading edge adjacent the outer surface and forming a connection ridge along the outer surface; and (iii) a cover strip comprising a compressed compressible cover material covering said connection ridge. Also described are a packaging system for flexible film and a multilayer flexible film packaging tape.

14 Claims, 4 Drawing Sheets

(51) Int. Cl.
*B65D 65/14* (2006.01)
*B65D 85/672* (2006.01)

(56) References Cited

U.S. PATENT DOCUMENTS

| | | | | |
|---|---|---|---|---|
| 3,390,762 | A | 7/1968 | Mernieks | |
| 3,602,449 | A | 8/1971 | Sroka et al. | |
| 3,737,030 | A | 6/1973 | Stewart | |
| 3,770,542 | A * | 11/1973 | Hall | B65H 75/00 156/184 |
| 4,554,193 | A | 11/1985 | Erickson | |
| 4,887,714 | A * | 12/1989 | O'Connor | B65D 57/00 206/411 |
| 5,415,912 | A | 5/1995 | Ushizaka et al. | |
| 5,476,712 | A | 12/1995 | Hartman et al. | |
| 5,514,429 | A * | 5/1996 | Kamihgaraguchi | B65H 75/10 138/132 |
| 5,797,240 | A | 8/1998 | Martin-Cocher et al. | |
| 6,194,476 | B1 | 2/2001 | Ridder et al. | |
| 6,217,696 | B1 | 4/2001 | Hartmann et al. | |
| 6,414,073 | B1 | 7/2002 | Nakamura et al. | |
| 6,695,320 | B2 | 2/2004 | Busby et al. | |
| 6,921,566 | B2 | 7/2005 | Lipstein | |
| 7,442,739 | B1 | 10/2008 | Hatfield | |
| 7,781,056 | B2 | 8/2010 | Bries | |
| 8,332,962 | B1 | 12/2012 | Machado | |
| 2002/0190152 | A1 * | 12/2002 | Haraikawa | B65H 18/28 242/520 |
| 2007/0048478 | A1 | 3/2007 | Webster | |
| 2010/0323191 | A1 | 12/2010 | Sugo et al. | |
| 2013/0051888 | A1 | 2/2013 | Norimatsu | |
| 2013/0122290 | A1 | 5/2013 | Tynan, Jr. | |
| 2014/0366799 | A1 | 12/2014 | Vulpitta et al. | |
| 2015/0298422 | A1 | 10/2015 | Lodde et al. | |
| 2016/0177135 | A1 | 6/2016 | Allen | |
| 2016/0280404 | A1 | 9/2016 | Porter et al. | |
| 2018/0030314 | A1 | 2/2018 | Czerwonatis et al. | |

FOREIGN PATENT DOCUMENTS

| | | | |
|---|---|---|---|
| JP | H11 33626 | A | 2/1999 |
| WO | WO 2014/061264 | A1 | 4/2014 |

OTHER PUBLICATIONS

Jones, "Methods of Reducing Roll Faults Caused by Poor Thickness Profile," Emral Ltd., pp. 1-8, Accessed Sep. 24, 2015.
PCT International Search Report and Written Opinion dated Jan. 29, 2018 for International Application No. PCT/US2017/055833.
Office Action dated Apr. 18, 2019 received in co-pending U.S. Appl. No. 15/334,321.

* cited by examiner

PACKAGED FLEXIBLE FILM AND FLEXIBLE FILM PACKAGING SYSTEM THEREFOR

CROSS REFERENCE TO RELATED APPLICATIONS

This application is a continuation of U.S. patent application Ser. No. 15/334,321 filed on Oct. 26, 2016, now pending, the disclosures of which are herein incorporated by reference in their entirety to the extent they do not contradict the statements herein.

FIELD OF THE INVENTION

The present invention relates to packaged flexible polymer films and packaging systems for flexible polymer films.

BACKGROUND OF THE INVENTION

In the prior art, flexible films formed from polymeric materials and/or plastics are typically packaged at the manufacturing site as rolls, with the film wound onto a cylindrical supporting carrier formed from rigid plastic, cardboard or the like (known as a core). The core is then enclosed and contained in a box, bag or other packaging to protect the film during transport and provide an aesthetically pleasing appearance to customers. For some products, for example films for application to windows installed in automobiles and buildings, the flexible films are often packaged during manufacture in large and heavy "bulk" rolls; however, product distribution channel requirements demand that film wound on such bulk rolls be unwound and then rewound into smaller "commercial" rolls for shipping and eventual sale. By way of example, such window films are often wound on bulk rolls of around 3000 meters at manufacture and then repackaged for sale to customers in relatively short rolls wherein 30.5 meters or less of material is wound on a 76.5 mm diameter plastic core. Highly specialized flexible films, such as metallized films for use in medical testing devices, electronic devices, displays and the like, are also packaged as rolls of material wound on a core.

So that the film can be wound onto the core properly for commercial rolls, the leading end of the film nearest the core is typically adhered to the core using a double-sided self-adhesive strip that runs transversely along the full width of the film at the leading edge. When the film is unwound from the commercial roll for use, the 1-3 meters of the film packaged nearest the core when originally wound thereon, is often found to be unusable as a result of a repeating imprint, sometimes referred to as an "embossment", created in the initial wraps of the film around the core. Because the flexible film is relatively thin, in the order of 60-400μ, this imprint effect is replicated in several of the innermost layers of wound film close to the core. These imprints are caused by one or more factors typically present in the packaging process and system acting alone or in combination. These include:

Film tension. Mechanical requirements demand that tension is applied during winding in order to be able to process film through the winding machine.

Film Edge. The leading end of the film runs across the width of the wound film and is cut with a relatively sharp vertical right-angled edge that forms a ridge at the interface of the film's leading edge with surface of the core.

Adhesive Strip. The double sided adhesive strip has a minimized (typically 25-50μ) but nonetheless potentially impactful thickness and can create an even more severe imprint than the end of the film. It presents two ends rather than one and the general evenness of the thickness of adhesive strip over the entire area of adhesive, particularly hand-applied aerosol pressure sensitive adhesives, can be very poor.

Core surface. The core surface itself may have defects or minute contaminants that impact its uniformity and smoothness.

Imprints or embossments created in films via the above are typically permanent such that, if use of the film is attempted, defects in the final product's functionality and/or aesthetic appearance are highly likely. With respect to window films, installation of this portion of the film from the roll on a vehicle or building window is often the source for consumer complaints and warranty claims.

One prior art attempt to overcome the embossment problem included chamfering the leading edge of the film so that the cut end of the film is angled or gradually reduced in thickness rather than presenting a sharp vertical end. It is difficult with such thin materials, however, to achieve any uniform angled cut of this kind, particularly at such a shallow angle as would be necessary to materially reduce the impact of the leading end on the imprint problem. Other prior art methods to reduce imprinting involve changing aspects of the core, for example (i) milling an angled depression into the length of the core such that the leading end of the film seats in the depression in the core so as to present a smooth surface over which subsequent layers of film wrap during winding onto the core or (ii) modifying the core to include a slit or other feature to "trap" and/or hold the leading end of the film within the core cavity. Such solutions are, however, typically not cost effective as they add expensive machining, molding, slitting or other high-precision steps to the core manufacturing process and create the need for cores that are highly customized to match individual film types and thicknesses. Further, they also present challenges in properly adhering the leading edge of the film to the core so that the roll can be properly wound.

Despite these prior art efforts, embossments remain a significant source of waste and inefficiency for the flexible films industry. Aside and apart from the embossment problem, the films industry is in lock step with industry in general as it seeks out improved, sustainable packaging systems and for its products that reduce excess packaging material and waste.

SUMMARY OF THE INVENTION

In a first aspect, the present invention relates to a packaged flexible film. The packaged flexible film includes (i) a cylindrical core having an outer surface; (ii) a supply of flexible film wound about the core with a leading edge adjacent the outer surface and forming a connection ridge along the surface; and (iii) a cover strip comprising a compressed compressible cover material covering said connection ridge. The compression of the compressible cover material is effected by a compression force that is applied to the compressible cover material by the film when wound about the core under tension.

In another aspect, the present invention relates to a packaging system for flexible film which includes a leading edge and a terminal edge and which is windable about a cylindrical core. The packaging system includes (i) a cylindrical core having an outer surface; and (ii) a cover strip attachable to the outer surface. The cover strip includes a compressible cover material and has dimensions sufficient for at least covering a connection ridge that is formed along the outer surface at said leading edge of the flexible film when the film is wound about the core. Typically, the dimensions will extend from at least ¼ inch in width and a length approximately equivalent to the longitudinal length of the cylindrical core, most commonly from 12 inches to 84 inches; however, it will be understood that rolled film packages with cores in excess of 120 inches are known in the art.

In still another aspect, the present invention relates to a multilayer flexible film packaging tape for covering the connection ridge that is formed along the outer surface of a core at the leading edge of a flexible film when the film is wound about the core as part of a packaged flexible film. The multilayer flexible film packaging tape includes a carrier substrate with a top surface and bottom surface; a compressible layer atop said top surface; and a mounting adhesive on said bottom surface.

In yet another aspect, the present invention relates to a method for packaging a flexible film onto a core with an outer surface. The method includes (i) attaching a leading edge of said flexible film onto said outer surface of said core thereby forming a connection ridge; (ii) applying a cover strip over said connection ridge, said cover layer comprising a compressible cover material; and (iii) winding said flexible film around said core under tension such that said film applies compression force to said compressible material sufficient to deform said compressible material.

Further aspects of the invention are as disclosed and claimed herein.

BRIEF DESCRIPTION OF THE DRAWINGS

The invention will be described in further detail below and with reference to the accompanying drawings, wherein like reference numerals throughout the figures denote like elements and in wherein.

DETAILED DESCRIPTION

Figure 1:
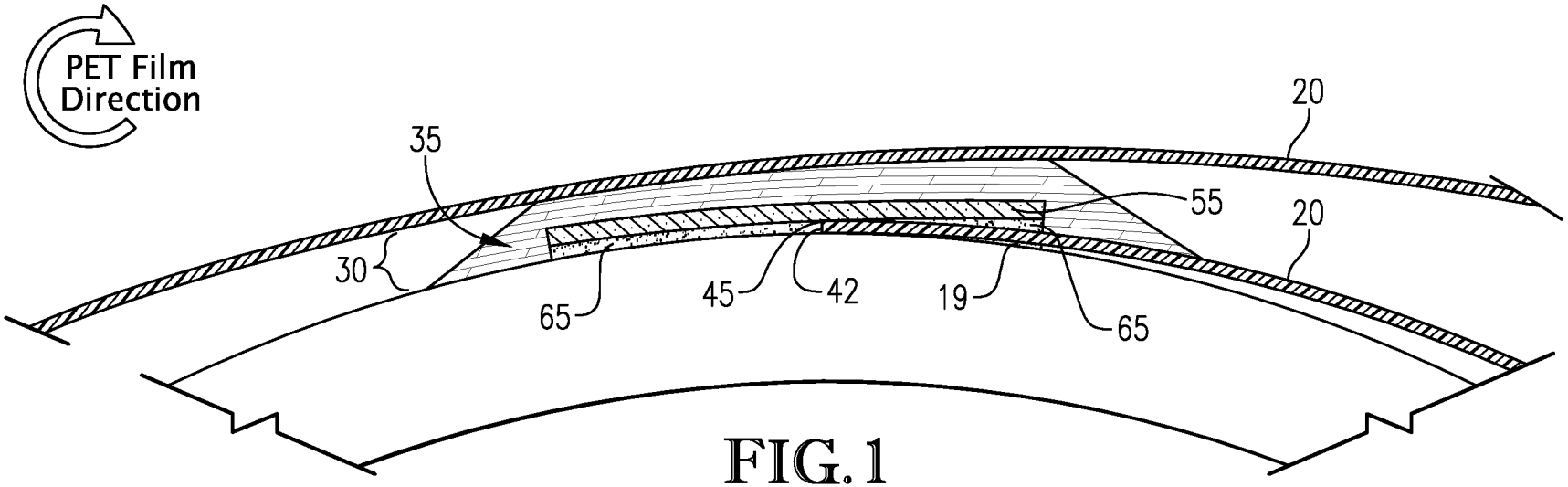
FIG. 1 is a side elevational view, partially in cross-section, of an embodiment of the packaged flexible film of the present invention with a cover strip as shown in FIG. 3.
Figure 2:
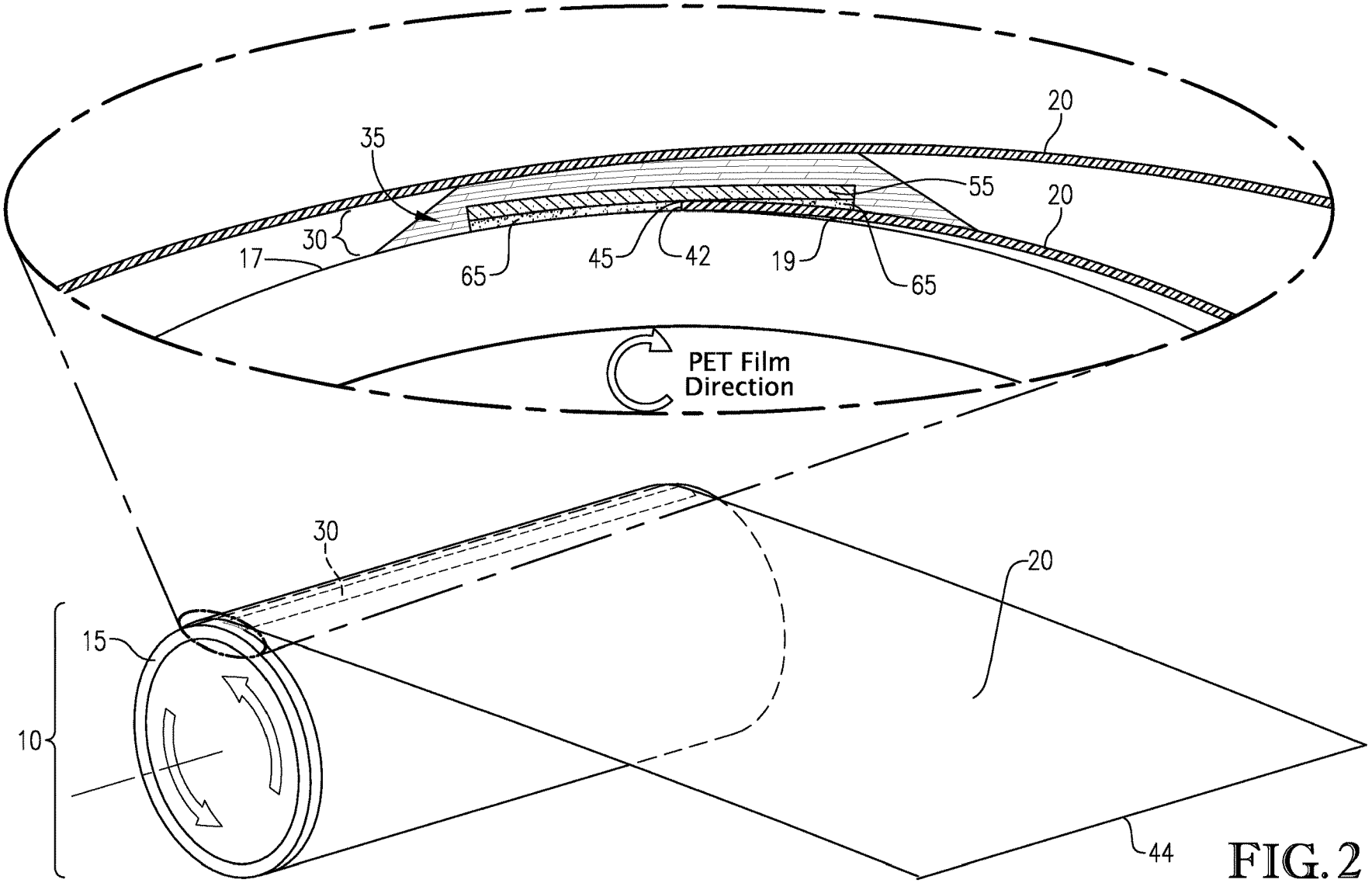
FIG. 2 is a perspective view, partially in cross-section, of an embodiment of the packaged flexible film of the present invention with a cover strip as shown in FIG. 3.

The present invention, in a first aspect depicted in FIGS. 1 and 2, relates to a packaged flexible film 10. The packaged flexible film 10 broadly includes (i) a cylindrical core 15 having an outer surface 17; (ii) a supply of flexible film 20 wound about the core 15 and (iii) a cover strip 30 including a compressed compressible cover material 35. The flexible film includes a leading edge 42 which is adjacent the outer surface 17 and which forms a connection ridge 45 along the outer surface 17. Optionally, the flexible film 20 is attached to the outer surface 17 of the core 15 with an adhesive 19 such as pressure sensitive adhesive which adheres the flexible film 20 to the outer surface 17 of the core 15 generally along the leading edge 42. Pressure sensitive adhesives are well known in the art and may be formed for example from natural rubber, synthetic rubbers (e.g., styrene/butadiene copolymers (SBR) and styrene/isoprene/styrene (SIS) block copolymers), various (meth)acrylate (e.g., acrylate and methacrylate) copolymers and silicones. Suitable pressure sensitive adhesives for attaching film 20 to the outer surface 17 of the core 15 are described for example in U.S. Pat. Nos. 5,415,912 and 6,414,073 and U.S. Published Application number US20100323191A1, the disclosures of which are incorporated herein by reference, as well as more generally in Benedek, *Pressure-Sensitive Adhesives and Applications,* 2$^{nd}$ Ed., 2004.

The flexible film also includes a terminal edge 44. The cover strip 30 that includes the compressed compressible cover material 35 covers the connection ridge 45.

The compression of the compressible cover material is effected by a compression force that is applied to the compressible cover material by the film when wound about the core under tension. As described in more detail below and shown in FIGS. 4 and 5, the compressible cover material 160 of the cover strip 130 of the packaging system of the present invention, when used in conjunction with the packaged flexible film of the present invention, deforms, flows or migrates under this compression force such that compressed compressible cover material 35 is characterized by a reduced thickness over the connection ridge 45 when compared to the compressible cover material 160 in an uncompressed state as exemplified by the compressible cover material 160 of the cover strip 130 of the packaging system of the present invention.

Compounds and compositions suitable for the compressible cover materials used for the compressed compressible cover material are materials known in the art that deform, flow or migrate under compression such as the compression force applied by the wound film as described above. Suitable materials include flexible and semi-rigid foams, in particular low density polyurethane foams and closed-cell vinyl foams, gels, elastomeric materials such as rubbers and polymeric compositions such as silicones, in particular compressible silicones, acrylics and the like. Non-limiting examples of suitable materials known in the art and commercially available include materials used in commercial flexible caulk applications such as Big Stretch® available from Sashco Inc. or KWIK SEAL® ULTRA Premium Siliconized Sealant available from DAP Products Inc.; hot melt PSAs such as described in U.S. Pat. No. 7,442,739B1, the disclosure of which is incorporated herein by reference; foams offered by Rogers Corporation under the tradename Poron®; compressible silicones such as described in U.S. Pat. No. 6,194,476, the disclosure of which is incorporated herein by reference; and the silicone gels offered by Wacker Chemie AG under the tradenames SilGel®, ELASTOSIL® AND POWERSIL®. The compressed compressible material covers the connection ridge 45 and helps protect against the creation of undesirable embossment in the flexible film 20 by the connection ridge 45 while also avoiding formation of a separate seam or edge that itself could create an embossment risk.

One of ordinary skill will appreciate in view of the above that numerous factors, including without limitation the compressibility and other characteristics of the compressible material, the compression force generated by the wound flexible film, flexible film winding conditions such as winding tension and velocity and flexible film modulus, length, width, amount, type and thickness should be weighed and considered in conjunction with selection of the compressed compressible material that is most suitable for a given packaged flexible film.

Preferably, the cover strip 30 is attached to the leading edge 42 of the flexible film and to the outer surface 17 of the core, most preferably by adhesive 65 such as a pressure sensitive adhesive. Pressure sensitive adhesives are well known in the art and may be formed for example from natural rubber, synthetic rubbers (e.g., styrene/butadiene copolymers (SBR) and styrene/isoprene/styrene (SIS) block copolymers), various (meth)acrylate (e.g., acrylate and methacrylate) copolymers and silicones. Suitable pressure sensitive adhesives for attaching film 20 to the outer surface 17 of the core 15 are described for example in U.S. Pat. Nos. 5,415,912 and 6,414,073 and U.S. Published Application number US20100323191A1, the disclosures of which are incorporated herein by reference, as well as more generally in Benedek, *Pressure-Sensitive Adhesives and Applications,* $2^{nd}$ Ed., 2004.

The flexible film 20 that is a component of the packaged flexible film of the present invention may be any flexible film, web or the like typically packaged concurrent with or after manufacturing as a roll wound on a core. Non-limiting examples include films and webs and the like formed from PET, polypropylene, PVC, polyurethane, biaxially oriented polystyrene, cellulose triacetate, PTFE, polyamides and polyethylenes.

The cylindrical core 15 may be formed from any material known in the art for such a purpose. Suitable materials for forming the cylindrical core include various plastics and polymeric materials, particularly those processable by injection molding or extrusion processes, paperboard, cardboard and the like. Non-limiting examples of suitable polymeric materials include polyethylene, polypropylene, polyethylene terephthalate and polycarbonates. Typically, the cylindrical core (and therefore as a consequence its outer surface) is desirably stiff and rigid so as to properly support the flexible film and the materials for it are selected accordingly; however, it will be understood that the core and in particular its outer surface, may exhibit some degree of elasticity or flexibility.

Figure 3:
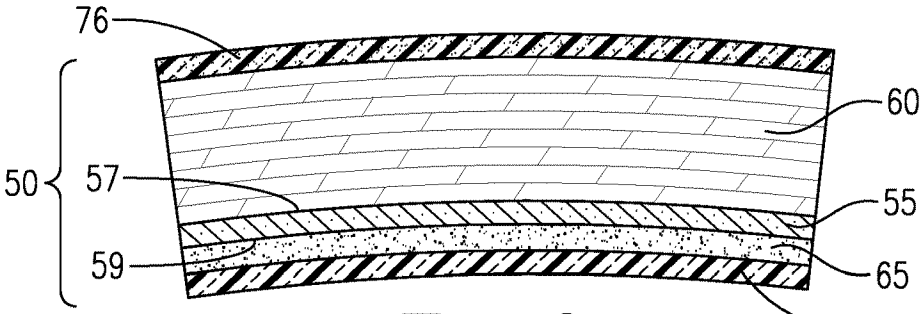
FIG. 3 is a side cross-sectional view of an embodiment of the cover strip of the present invention.

In a preferred embodiment, the cover strip 30 is a multilayer flexible film packaging tape 50 as shown in FIG. 3. The tape 50 includes a carrier substrate 55 with a top surface 57 and bottom surface 59; a compressible layer 60 including compressible cover material atop said top surface 57; and a mounting adhesive 65 such as a pressure-sensitive adhesive on the bottom surface 59. When in use as the cover strip component of the packaged flexible film 20, the tape 50 covers the connection ridge 45 that is formed along the outer surface 17 of the core 15 at the leading edge 42 of the flexible film 20 when the film 20 is wound about the core 15. Further, when the tape is used as the cover strip of the packaged flexible film 20, the compressible layer 60 of tape 50 is compressed by compression force applied thereto by the film when wound about the core under tension, thereby forming the compressed compressible cover material 35 of the packaged film of the present invention.

The multilayer flexible film packaging tape 50 may optionally include additional layers or components. For example, the tape may optionally include an adhesive between the compressible layer 60 and the carrier substrate 55 to improve structural integrity. Further, the tape may include a removable release liner 76 atop the compressible layer; a removable release liner 77 atop the mounting adhesive; or a combination thereof, i.e. a first removable release liner atop the compressible layer and a second removable release liner atop the mounting adhesive. One of ordinary skill will appreciate that release liners such as those described typically serve a protective function and are removed prior to actual use of the multilayer flexible film packaging tape.

In general, adhesive tape constructions useful for other end use applications, and methods for their manufacture, are well known in art. Such tapes are commercially available and are described for example in WO 2016/106040. A wide variety of foam tapes for sealing and cushioning applications are available from 3M, for example under 3M product codes 4116, 4317 and 4516. A mounting tape with compensating compression for use with printing plates is commercially available from Lohmann under the tradename Duplo-FLEX®.

While the preferred embodiment of the cover strip 30, namely the multilayer flexible film packaging tape 50, has been described in detail above and in the accompanying Figures, one of ordinary skill will appreciate that other embodiments may be contemplated. By way of non-limiting example, the cover strip 30 may be a compressible coating covering the connection ridge 45 and applied by spray coating or other known coating deposition techniques prior to winding of the flexible film about the core. Alternatively, the cover strip 30 may be a layer of a compressible extrudate covering the connection ridge 45 and applied by extrusion or other known application techniques prior to winding of the flexible film about the core. Still another alternative for the cover strip 30 is a pre-formed cushioning or compressible foam attachable over the connection ridge 45 using an adhesive pre-applied to the connection ridge prior to attachment.

The packaged flexible film of the present invention is assembled by a method for packaging a flexible film onto a core with an outer surface. The subject method, another aspect of the present invention, includes (i) attaching a leading edge of the flexible film onto the outer surface of the core thereby forming a connection ridge; (ii) applying a cover strip over the connection ridge, the cover strip comprising a compressible cover material; and (iii) winding the flexible film around said core under tension such that said film apples compression force to said compressible material sufficient to deform said compressible material.

The attaching step (i) of the present invention optionally includes applying an adhesive to adhere the leading edge of the flexible film onto the outer surface of the core. The attaching step (i) can optionally be a step of removably attaching the leading edge such that the leading edge is removable from the core for subsequent use. Similarly, the applying step (ii) optionally includes applying an adhesive to adhere the cover strip to the leading edge and the flexible film and to the surface of the core; however, one of ordinary skill will appreciate that such one or both adhesive application steps may not be required, if for example the cover strip is the multilayer flexible film packaging tape described above, as the tape includes a mounting adhesive layer. The winding step (iii) may be performed using techniques and equipment known in the art and commercially available for example from Cattorini—Italy or Kobayashi Engineering Works, Ltd. It will be appreciated by a person of ordinary skill that winding variables such as film feed velocity and winder rotation speed, as well as film variables such as material, construction, thickness, dimensions and the like, will necessarily have to be considered and balanced to ensure that, as the film is wound upon the core, the film tension translates to application of a compression force to the compressible material of the cover strip sufficient to deform said compressible material.

Figure 4:
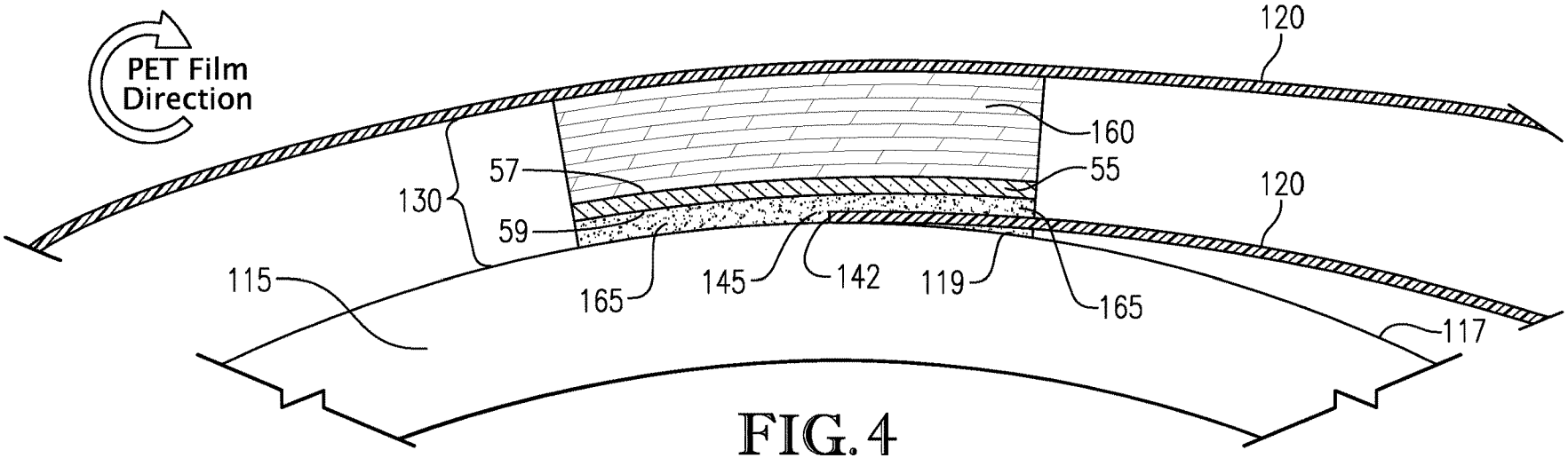
FIG. 4 is a side elevational view, partially in cross-section, of an embodiment of the packaging system of the present invention with a cover strip as shown in FIG. 3 and with the flexible film shown partially wound about the core for illustration purposes only.
Figure 5:
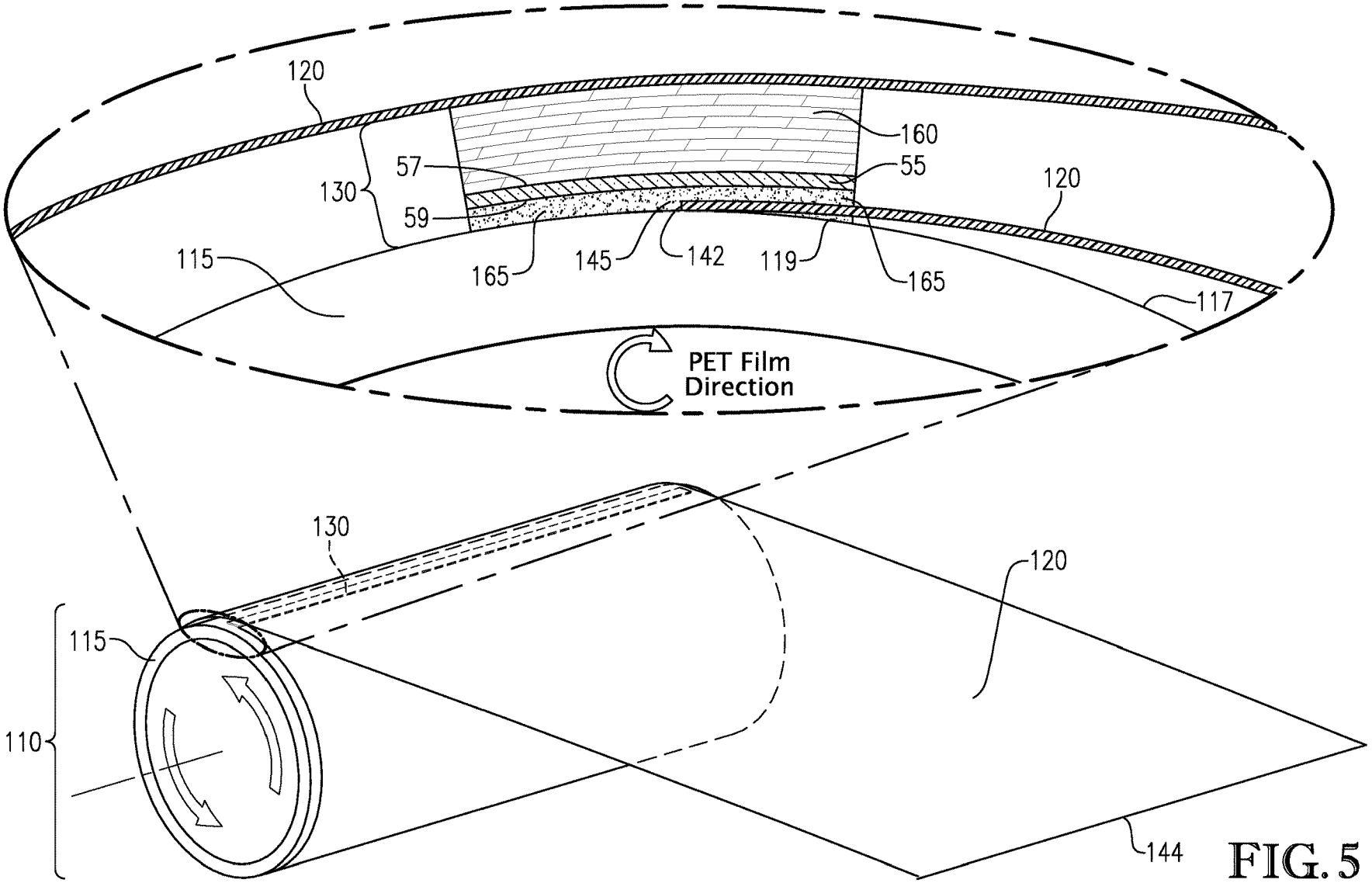
FIG. 5 is a perspective view, partially in cross-section, of an embodiment of the packaging system of the present invention with a cover strip as shown in FIG. 3 and with the flexible film shown partially wound about the core for illustration purposes only.

The present invention, in another aspect depicted in FIGS. 4 and 5, relates to a packaging system 110 for a flexible film that is windable about a cylindrical core. The system includes (i) a cylindrical core 115 having an outer surface 117; and (ii) a cover strip 130 that is attachable to the outer surface 117 and that includes a compressible cover material 160. The flexible film 120 has a leading edge 142 and a terminal edge 144 and the cover strip 130 has dimensions sufficient for covering at least a connection ridge 145 that is formed along said outer surface 117 at said leading edge 142 of said flexible film 120 when the flexible film 120 is wound about the core. The packaging system also optionally includes an adhesive 119 to adhere and attach the flexible film 120 onto the outer surface 117 of the core 115 generally along the leading edge 142 as well as an optional adhesive 165 to adhere the cover strip 130 over the connection ridge 145.

When the packaging system of the present invention is in use, particularly when utilized in conjunction with the packaged flexible film of the present invention, the compressible cover material 160 of the cover strip 130 is compressed by the flexible film 120 when wound about the core 115 under tension and deforms, flows or migrates under this compression force such that its thickness over the connection ridge as part of the flexible film package of the present invention is reduced. The compressible material is thereby compressed to form the compressed compressible cover material 35 of the packaged flexible film of the present invention as described above. The thickness of the compressed compressible cover material over the connection ridge 145 is reduced compared to the compressible cover material 160 of the cover strip 130 and accordingly is less than the thickness of the compressible cover material.

In a preferred embodiment of the packaging system of the present invention, the cover strip 130 is a multilayer flexible film packaging tape 50 as described herein above and depicted at FIG. 3. Nonetheless, one of ordinary skill will appreciate that other embodiments may be contemplated. By way of non-limiting example, the cover strip 130 may be a compressible coating covering the connection ridge 145 and applied by spray coating or other known coating deposition techniques prior to winding of the flexible film 120 about the core 115. Alternatively, the cover strip 130 may be a layer of a compressible extrudate for covering the connection ridge 145 and applied by extrusion or other known application techniques prior to winding of the flexible film 120 about the core 115.

Compounds and compositions suitable for the compressible cover material 130 are materials known in the art to deform, flow or migrate under compression such as the compression force applied by the wound film as described above. Suitable materials include flexible and semi-rigid foams, in particular polyethylene foams, low density polyurethane foams and closed-cell vinyl foams, gels, elastomeric materials such as rubbers and polymeric compositions such as silicones, in particular compressible silicones, acrylics and the like. Non-limiting examples of suitable materials known in the art and commercially available include materials used in commercial flexible caulk applications such as Big Stretch® available from Sashco Inc. or KWIK SEAL® ULTRA Premium Siliconized Sealant available from DAP Products Inc.; hot melt PSAs such as described in U.S. Pat. No. 7,442,739B1, the disclosure of which is incorporated herein by reference; foams offered by Rogers Corporation under the tradename Poron®; compressible silicones such as described in U.S. Pat. No. 6,194,476, the disclosure of which is incorporated herein by reference; and the silicone gels offered by Wacker Chemie AG under the tradenames Sil-Gel®, ELASTOSIL® AND POWERSIL®. The compressed compressible material covers the connection ridge 45 and helps protect against the creation of undesirable embossment in the flexible film 20 by the connection ridge 45 while also avoiding formation of a separate seam or edge that itself could create an embossment risk. One of ordinary skill will appreciate in view of the above that numerous factors, including without limitation the compressibility and other characteristics of the compressed compressible material, the compression force generated by the wound flexible film, flexible film winding conditions such as velocity and flexible film amount, type and thickness should be weighed and considered in conjunction with selection of the compressed compressible material that is most suitable for a given packaged flexible film.

Preferably, the cover strip 130 is attached to the leading edge 142 of the flexible film 120 and to the outer surface 117 of the core 115, more preferably with an adhesive 119 such as pressure sensitive adhesive. Pressure sensitive adhesives are well known in the art and may be formed for example from natural rubber, synthetic rubbers (e.g., styrene/butadiene copolymers (SBR) and styrene/isoprene/styrene (SIS) block copolymers), various (meth)acrylate (e.g., acrylate and methacrylate) copolymers and silicones. Suitable pressure sensitive adhesives for attaching film 120 to the outer surface 117 of the core 115 are described for example in U.S. Pat. Nos. 5,415,912 and 6,414,073 and U.S. Published Application number US20100323191A1, the disclosures of which are incorporated herein by reference, as well as more generally in Benedek, *Pressure-Sensitive Adhesives and Applications,* $2^{nd}$ Ed., 2004.

The flexible film 120 for use with the packaging system of the present invention may be any flexible film, web or the like typically packaged concurrent with or after manufacturing as a roll wound on a core. Non-limiting examples include films and webs and the like formed from PET, polypropylene, PVC, polyurethane, biaxially oriented polystyrene, cellulose triacetate, PTFE, polyamides and polyethylenes.

The cylindrical core 115 may be formed from any material known in the art for such a purpose. Suitable materials for forming the cylindrical core include various plastics and polymeric materials, particularly those processable by injection molding or extrusion processes, paperboard, cardboard and the like. Non-limiting examples of suitable polymeric materials include polyethylene, polypropylene, polyethylene terephthalate and polycarbonates. Typically, the cylindrical core is desirably stiff and rigid so as to properly support the flexible film and the materials for it are selected accordingly; however, it will be understood that the core and in particular its outer surface, may exhibit some degree of elasticity or flexibility.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

That which is claimed is:

1. A packaging system for flexible film windable about a cylindrical core, said flexible film comprising a leading edge and a terminal edge, said system comprising:

(i) the cylindrical core, having an outer surface;

(ii) a cover strip attachable to said outer surface and comprising a compressible cover material, said cover strip having dimensions sufficient for covering at least a connection ridge formed along said outer surface at said leading edge of said flexible film when said film is wound about said core; and an adhesive for adhering said flexible film to said outer surface of said cylindrical core along the leading edge of the film.

2. The system of claim 1 wherein said cover strip is a multilayer tape comprising a carrier substrate with a top surface and bottom surface, a compressible layer comprising said compressible cover material atop said top surface and a mounting adhesive on said bottom surface.

3. The system of claim 2 further comprising a first removable release liner atop said compressible layer.

4. The system of claim 3 further comprising a second removable release liner atop said mounting adhesive.

5. The system of claim 1 wherein said cover strip is a compressible coating.

6. The system of claim 1 wherein said cover strip is a layer of a compressible extrudate.

7. The system of claim 1 wherein said cover strip is a pre-formed cushioning or compressible foam.

8. A packaged flexible film comprising the packaging system of claim 1, and further comprising a supply of flexible film wound about said cylindrical core with a leading edge adjacent said outer surface, adhered to said outer surface of said cylindrical core along said leading edge of the film by said adhesive, and forming a connection ridge along said surface; wherein the cover strip covers said connection ridge.

9. The packaged flexible film of claim 8 wherein said cover strip is attached to said leading edge and said outer surface.

10. The packaged flexible film of claim 8 wherein said cover strip is a multilayer tape comprising a carrier substrate with a top surface and bottom surface, a compressible layer comprising said compressible cover material atop said top surface and a mounting adhesive on said bottom surface.

11. The packaged flexible film of claim 8 wherein said cover strip is a compressible coating.

12. The packaged flexible film of claim 8 wherein said cover strip is a layer of a compressible extrudate.

13. The packaged flexible film of claim 8 wherein said cover strip is a pre-formed cushioning or compressible foam.

14. A method of using the packaging system of claim 1, the method comprising:

(i) attaching the leading edge of the flexible film onto the outer surface of the core by means of the adhesive, thereby forming the connection ridge;

(ii) applying the cover strip over the connection ridge; and (iii) winding the flexible film around the core under tension such that the film applies compression force to the compressible material sufficient to deform the compressible material.

* * * * *